US007037212B2

(12) United States Patent
Ashida et al.

(10) Patent No.: US 7,037,212 B2
(45) Date of Patent: May 2, 2006

(54) FIBER REINFORCED PLASTIC GOLF SHAFT

(75) Inventors: Hiroki Ashida, Osaka (JP); Takashi Ishii, Osaka (JP); Susumu Hironaka, Gifu-ken (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/814,776

(22) Filed: Mar. 31, 2004

(65) Prior Publication Data

US 2004/0192462 A1 Sep. 30, 2004

(30) Foreign Application Priority Data

Mar. 31, 2003 (JP) ..... 2003-096653

(51) Int. Cl.
*A63B 53/10* (2006.01)

(52) U.S. Cl. ..... 473/319

(58) Field of Classification Search ..... 473/316–323
See application file for complete search history.

(56) References Cited

U.S. PATENT DOCUMENTS 3,998,458 A * 12/1976 Inoue et al. ..... 473/319
4,157,181 A * 6/1979 Cecka ..... 473/319
5,143,374 A * 9/1992 Shibasaki ..... 473/319
5,716,291 A 2/1998 Morrell et al.
5,717,205 A * 2/1998 Matsumoto ..... 250/306
6,478,689 B1 * 11/2002 Hisamatsu ..... 473/287
6,485,376 B1 * 11/2002 Hisamatsu ..... 473/319

FOREIGN PATENT DOCUMENTS

| | | |
|---|---|---|
| JP | 07-163689 | 6/1995 |
| JP | 2622428 | 6/1997 |
| JP | 2001-170232 | 6/2001 |
| JP | 2001-212273 | 8/2001 |
| JP | 2001-276288 | 10/2001 |

* cited by examiner

*Primary Examiner*—Stephen Blau
(74) *Attorney, Agent, or Firm*—Troutman Sanders LLP; Gerald R. Boss, Esq.

(57) ABSTRACT

A golf shaft made of fiber reinforced plastic and including a tip portion attached to a head, a butt portion attached to a grip, and a middle portion located between the tip portion and the butt portion. The golf shaft has a generally tapered shape in which the outer diameter generally increases gradually from the tip portion to the butt portion. The golf shaft includes a first portion in which linear density is generally uniform. A second portion is defined by the part of the shaft excluding the first portion. The first portion occupies 30% or more of the entire shaft length, and the linear density of the first portion is greater than that of the linear density.

8 Claims, 12 Drawing Sheets

FIBER REINFORCED PLASTIC GOLF SHAFT

This application claims priority based on Japanese Patent Application Ser. No. 2003-096653, filed on Mar. 31, 2003.

BACKGROUND OF THE INVENTION

The present invention relates to a fiber reinforced plastic (FRP) golf shaft, and more particularly, to a golf shaft that enables easy swinging of the golf shaft regardless of vibrations produced after impact, and to a golf club using such a golf shaft.

A typical golf shaft is made of FRP using carbon fibers for the reinforcing fibers. An FRP golf shaft may be manufactured through a known sheet winding process, a filament winding process, or a braiding process.

In the sheet winding process, synthetic resin is impregnated in ropings extending parallel to each other to form sheets of prepregs, which are cut into predetermined shapes. The prepregs are superimposed on a mandrel so that they are provided with the designed characteristics. The prepregs are hardened and then removed from the mandrel to form an FRP golf shaft. The properties, the orientation angles relative to the shaft axis, and the thickness of the prepregs are designed to realize the designed characteristics of the golf shaft manufactured through the sheet winding process. Such prepregs are arranged along the entire length of the golf shaft.

The cross-sectional thickness of the shaft, or the quantity of the prepregs, is constant so that the prepregs are isotropic in the radial direction. In some cases, the tip portion of the shaft, at which the head is connected, or the butt portion of the shaft that is closer to the grip may be partially reinforced. In such a shaft, the thickness of the shaft is substantially uniform except for the reinforced tip and butt portions. Further, the outer diameter of the golf shaft increases uniformly from the tip to the butt. Thus, the linear density along the axial direction of the shaft increases in a uniform manner from the tip portion to the butt portion.

In the filament winding process, fiber filaments are wound about a shaft forming mandrel to form a shaft. During the winding, the winding angle of the filaments relative to the shaft axis may be adjusted.

In the braiding process, resin is impregnated in fiber toes to form toe prepregs. The toe prepregs are then braided to form a shaft. Recent golf shafts (braiding shafts) are often manufactured through such process. Such a golf shaft has a high level in freedom of design with regard to flexural rigidity distribution and linear density distribution. In addition, such a golf shaft has satisfactory flexural strength and torsion strength.

There are a number of patent publications pertaining to golf shafts having linear density distributions that differ from normal shafts to enable the golf shafts to be swung more satisfactorily.

For example, Japanese Laid-Open Patent Publication No. 7-163689 describes a shaft provided with a mass formed by a balance weight. Japanese Patent No. 2622428 (corresponding to U.S. Pat. No. 5,716,291) describes a shaft having an outer diameter and an inner diameter that are changed in a sudden manner to partially expand the shaft. In both publications, the linear density is concentrated at portions excluding the tip portion and butt portion of the golf shaft, or at the central portion of the golf shaft.

However, the outer appearance, flexure feel, and strength of such a golf shaft are affected in an undesirable manner.

More specifically, in the golf shaft of Japanese Laid-Open Patent Publication No. 7-163689 provided with the mass, stress concentrates at the boundary between the mass and the shaft when the golf shaft is swung. This decreases strength. Further, the golf shaft does not flex smoothly at the portion where the mass is added.

In the partially expanded golf shaft of Japanese Patent No. 2622428 (U.S. Pat. No. 5,716,291), the golf shaft does not flex smoothly depending on the amount of change in shape (cross-sectional secondary moment). Further, the outer appearance of the golf shaft is somewhat strange. Accordingly, although conventional golf shafts have theoretically ideal mass distributions, they are unsatisfactory from the viewpoints of outer appearance, flexure feel during swinging, durability, and manufacturing ease.

Japanese Laid-Open Patent Publication No. 2001-170232 describes a golf club that increases linear density by 20% at a portion located 0.322 to 0.605 meters from the grip end (in a section covering 30% of the club length, with the center of the section located at a position corresponding to 48% of the club length from the grip end). Further, the golf club has a club mass distribution that is optimal for the club length. As a result, the golf club is swung with more ease and the driving distance is increased with less work.

Japanese Laid-Open Patent Publication No. 2001-212273 describes a golf shaft in which the taper angle of the outer diameter is less than the taper angle of the inner diameter. This concentrates the linear density at portions other than the tip and butt of the golf shaft, or the central portion of the golf shaft. As a result, the golf shaft is provided with the optimal mass distribution without affecting the outer appearance of the golf shaft or the flexure feel of the swung golf shaft.

Furthermore, Japanese Laid-Open Patent Publication No. 2001-276288 describes a golf shaft in which the orientation angle of braiding yarns in braid layers relative to the shaft axis are changed depending on the axial position of the shaft. This concentrates the linear density at portions other than the tip and butt of the golf shaft, or the central portion of the golf shaft.

In the golf shaft of each of the above three patent publications, the change in linear distribution of the shaft that enables the golf shaft to be swung with more ease refers to concentration of the linear density at the central portion. Each golf shaft of the above three patent publications enables the golf shaft to be swung with more ease prior to ball impact. Further, the golf shaft is provided with the optimal mass distribution that eases swinging without affecting the flexure feel and strength of the shaft.

However, in such a golf shaft, when hitting the ball off-center or when hitting the ground instead of hitting the ball, the impact feel and the vibrations that are conveyed to the player's hands are somewhat uncomfortable.

Among vibration modes produced subsequent to impact, in the mode that becomes dominant, the antinodes of the vibrations are at the head and grip, and the node of the vibrations is at a portion extending from near the central portion of the shaft to a portion relatively near the tip. In a shaft having a structure in which the mass increases at the portion corresponding to the node of the vibrations, vibration tends to be amplified. This is one factor that causes discomfort.

It is an object of the present invention to provide a golf shaft that does not cause discomfort caused by the impact feel and the vibrations conveyed to the player's hands, and that is easily swung up until impact without affecting-in an undesirable manner the outer appearance of the golf shaft, the flexure feel of the golf shaft during swinging, and the durability of the golf shaft.

SUMMARY OF THE INVENTION

One aspect of the present invention is a golf shaft including fiber reinforced plastic, a tip portion, a butt portion, and a middle portion located between the tip portion and the butt portion. The golf shaft includes a tapered shape having an outer diameter that generally increases gradually from the tip portion to the butt portion. The golf shaft further includes a first portion in which linear density is generally uniform, and a second portion defined by the part of the shaft excluding the first portion. The first portion occupies 30% or more of the entire shaft length, and the linear density of the first portion is greater than that of the second portion.

Another aspect of the present invention is a golf shaft including fiber reinforced plastic, a reinforced tip portion, a butt portion, and a middle portion located between the tip portion and the butt portion. The golf shaft includes a tapered shape having an outer diameter that generally increases gradually from the tip portion to the butt portion. The golf shaft further includes a portion excluding about 30% of the entire shaft length from the tip portion of the golf shaft and having a linear density that is generally uniform.

A further aspect of the present invention is a golf shaft including fiber reinforced plastic, a reinforced tip portion, a butt portion, and a middle portion located between the tip portion and the butt portion. The golf shaft includes a tapered shape having an outer diameter that increases gradually from the tip portion to the butt portion. The golf shaft further includes a linear density that is substantially uniform generally throughout the entire length of the shaft.

A further aspect of the present invention is a golf club including a golf shaft made of fiber reinforced plastic and having a tip portion including a tip, a butt portion including a butt, and a middle portion located between the tip portion and the butt portion. A head is attached to the tip portion of the shaft. A grip is attached to the butt portion of the shaft. The shaft includes a tapered shape having an outer diameter that increases gradually from the tip to the butt, a first portion in which linear density is generally uniform, and a second portion defined by the part of the shaft excluding the first portion, the first portion occupying 30% or more of the entire shaft length, and the linear density of the first portion being greater than that of the second portion.

A further aspect of the present invention is a golf club including a golf shaft made of fiber reinforced plastic and having a tip portion including a tip, a butt portion including a butt, and a middle portion located between the tip portion and the butt portion. A head is attached to the tip portion of the shaft. A grip is attached to butt portion of the shaft. A portion excluding about 30% of the entire shaft length from the tip portion of the golf shaft has a linear density that is generally uniform.

A further aspect of the present invention is a golf club including a golf shaft made of fiber reinforced plastic and having a tip portion including a tip, a butt portion including a butt, and a middle portion located between the tip portion and the butt portion. A head is attached to the tip portion of the shaft. A grip is attached to the butt portion of the shaft. Linear density is substantially uniform generally throughout the entire length of the shaft.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment according to the present invention will now be discussed with reference to the drawings.

Figure 1:
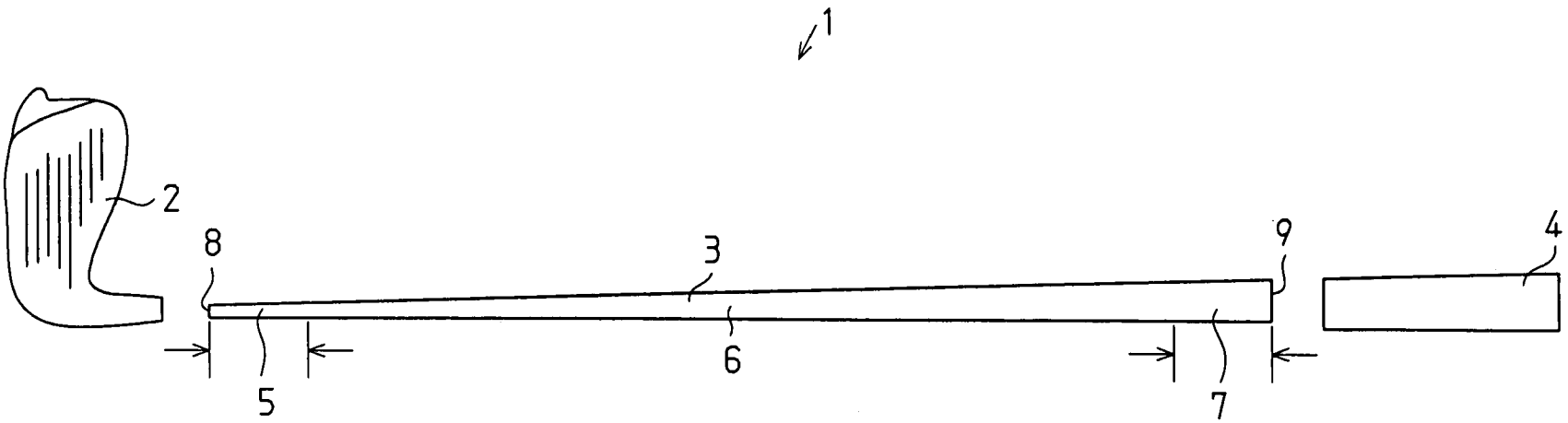
FIG. 1 is a schematic diagram of a golf club.

FIG. 1 is a schematic diagram showing a golf shaft 1. The golf shaft 1 includes a head 2, a shaft 3, and a grip 4. The shaft 3 has a reinforced tip portion 5 attached to the head 2, a butt portion 7 attached to the grip 4, and a central portion 6 located between the tip portion 5 and the butt portion 9. The outer diameter of the shaft 3 generally increases gradually from the tip 8 to the butt 9.

Normally, for a set of golf clubs, the details of each club, such as the weight and the distance from the grip end to the center of gravity of the club, are determined so that when a person lifts the club, the person feels as if every one of the clubs has the same weight. As described in Japanese Laid- Open Patent Publication No. 2001-170232, the length of an equivalent simple pendulum for such a club is shortened to effectively improve the swinging ease of the club. The inertial moment of the club at the grip end is one parameter that affects the perceptual feel when swinging the club, such as perceptions of a "heavy swing and light swing" or "easy to swing and difficult to swing." The club is normally perceived as being light when swung if the inertial moment is small. The two factors of the length of an equivalent simple pendulum of the club and the inertial moment of the club have been taken into consideration in the present invention.

In the present invention, for the length of an equivalent simple pendulum of the club, to comply with the analysis of the actual swing, the location of the swing axis was defined as the grip end, which substantially corresponds to the butt 9 of the shaft 3.

When the axis is the grip end, the length of the equivalent simple pendulum Lp (m), which is expressed in equation (1), is a value obtained by dividing the inertial moment I ($kgm^2$) by the club mass Mc (kg) and the distance R(m) from the grip end to the center of gravity G of the club.

$$Lp=I/(Mc\cdot R) \tag{1}$$

From the inertial characteristic of each part of the club, the inertial moment I about the grip end of the club is obtained from the inertial characteristic of each part of the club.

$$I=Igh+Igs+Igg+Mh\cdot(R-Lc)^2+Ms\cdot(R-Rs)^2+Mg\cdot(R-Rg)^2+Mc\cdot R^2 \tag{2}$$

In the equation, Mh (kg) represents the head mass, Ms (kg) represents the shaft mass, and Mg (kg) represents the grip mass. The sum of Mh, Ms, and Mg is Mc, which represents the club mass (kg). Further, Lc (m) represents the club length, Rg (m) represents the distance from the grip end to the center of gravity of the grip, Rs (m) represents the distance from the insertion end of the grip (butt 9 of the shaft) to the center of gravity of the shaft, Igh ($kgm^2$) represents the inertial moment of the head about a line lying along the center of gravity of the head in a direction perpendicular to the longitudinal direction of the shaft, Igs ($kgm^2$) represents the inertial moment of the shaft about a line lying along the center of gravity of the shaft in a direction perpendicular to the longitudinal direction of the shaft, and Igg ($kgm^2$) represents the inertial moment of the grip about a line lying along the center of gravity of the grip in a direction perpendicular to the longitudinal direction of the shaft or the grip.

A feature of the present invention is in that the linear density, which is the mass per unit length in the axial direction of the shaft, is set to decrease in both of the above two parameters.

The relationship of the linear density in the axial direction of the shaft with respect to the length of the equivalent simple pendulum Lp and the inertial moment I is analyzed as discussed below.

Figure 2:
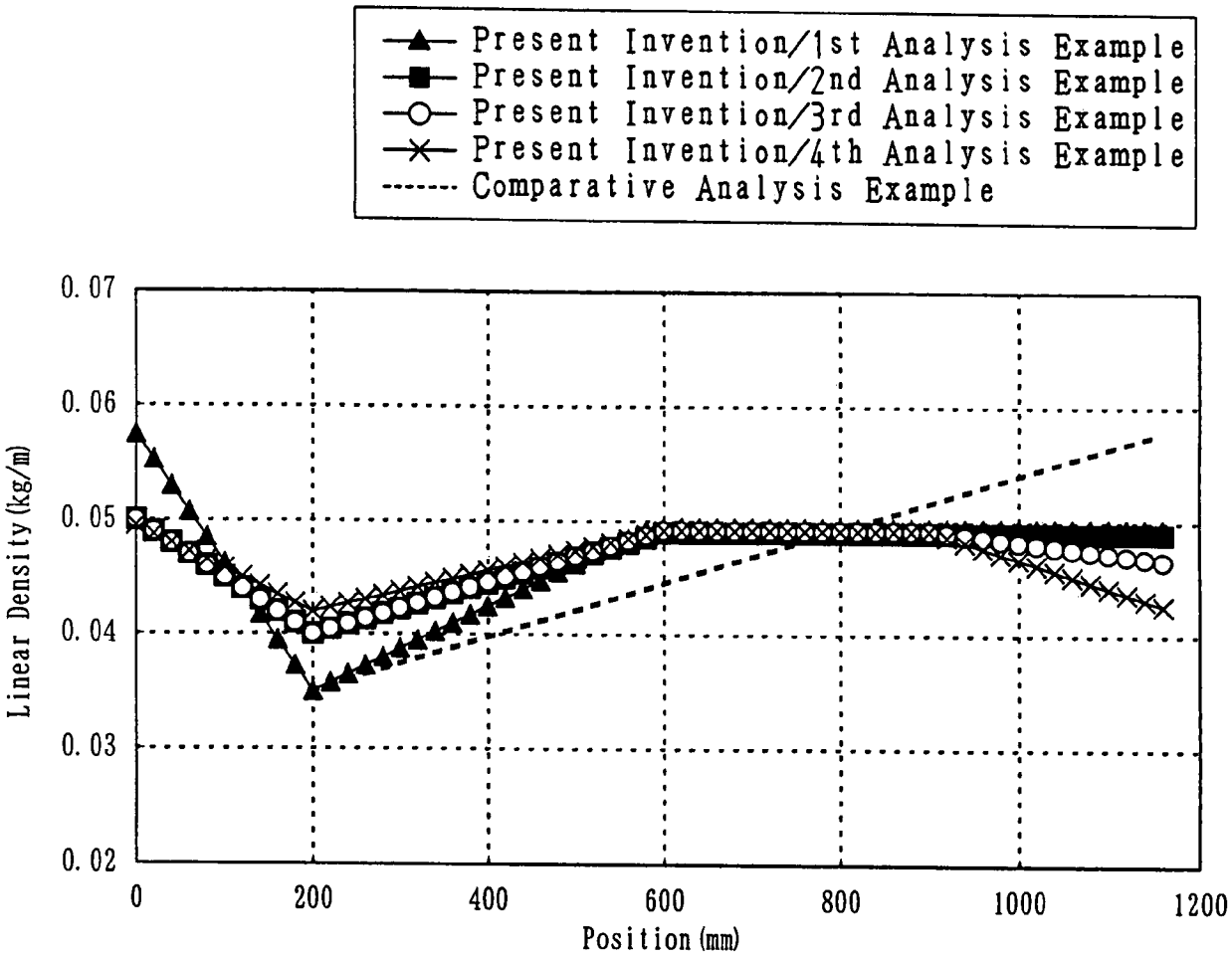
FIG. 2 is a graph showing the linear density distributions of first to fourth analysis examples of shafts according to the present invention and a shaft of a comparative analysis example.
Figure 3:
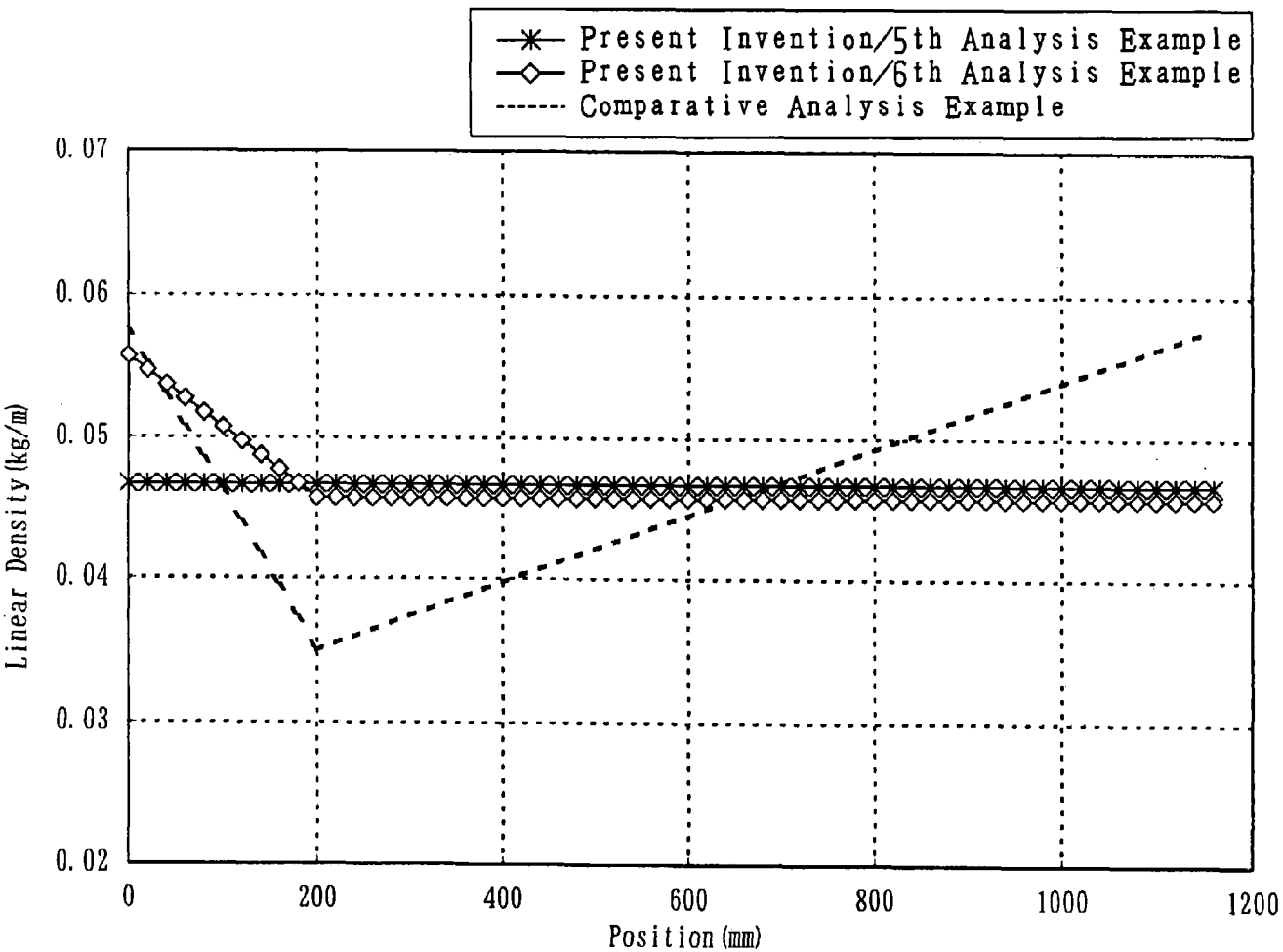
FIG. 3 is a graph showing the linear density distributions of fifth and sixth analysis examples of shafts according to the present invention and a shaft of the comparative analysis example.

FIGS. 2 and 3 show the linear density distribution in the shafts of first to sixth analysis examples of the present invention and in the shaft of a comparative analysis example. The shaft mass Ms is 0.055 kg in each of the first to sixth analysis examples and the comparative analysis example. The vertical axis represents the linear density (kg/m) and the horizontal axis represents the distance (mm) from the tip of the shaft.

In the shaft of the comparative analysis example, the linear density distribution is typical for a shaft manufactured through a sheet winding process. Further, the linear density increases uniformly towards the grip end (butt) except at the reinforced tip portion, which is attached to the head. In other words, the linear density is larger at positions closer to the head and the grip, and a minimal value exists, which is a feature of the sheet winding process.

Table 1 shows the properties of the shaft in each analysis example. In the comparative analysis example, the linear density is large at the tip side and the butt side. Thus, the inertial moment of the shaft about a line lying along the center of gravity of the shaft in a direction perpendicular to the longitudinal direction of the shaft Igs is largest in the comparative analysis example.

TABLE 1

| | length (mm) | mass Ms(g) | center of gravity (mm) baseline grip | center of gravity rate (%) baseline grip | inertial moment Igs (kg · m^2) about center of gravity of shaft |
|---|---|---|---|---|---|
| 1st example | 1143 | 55 | 555 | 48.6 | 0.00619 |
| 2nd example | 1143 | 55 | 558 | 48.8 | 0.00611 |
| 3rd example | 1143 | 55 | 560 | 49.0 | 0.00604 |
| 4th example | 1143 | 55 | 568 | 49.7 | 0.00598 |
| 5th example | 1143 | 55 | 572 | 50.0 | 0.00608 |
| 6th example | 1143 | 55 | 582 | 50.9 | 0.00624 |
| com. example | 1143 | 55 | 542 | 47.4 | 0.00644 |

Table 2 shows the inertial moment I about the grip end and the length of an equivalent simple pendulum Lp for each analysis example when the head mass Mh is 0.194±0.001 (kg), the grip mass Mg is 0.045 kg, the club length Lc is 45 inches (1143 mm), and the primary moment Mc·R is 0.259 kgm.

In the first to sixth analysis examples of the present invention, the values of the internal moment I and the length of the equivalent simple pendulum Lp are smaller than those of the comparative analysis example.

TABLE 2

| | club mass Mc(kg) | club center of gravity R(m) grip end | primary moment Mc · R (kg · m) | inertial moment I (kg · m^2) about grip end | length of equivalent simple pendulum Lp (m) | inertial moment Ig (kg · m^2) about center of gravity | 14" balance (–) |
|---|---|---|---|---|---|---|---|
| 1st example | 0.297 | 0.872 | 0.259 | 0.280 | 1.081 | 0.0541 | D0 |
| 2nd example | 0.297 | 0.872 | 0.259 | 0.280 | 1.080 | 0.0539 | D0 |
| 3rd example | 0.297 | 0.873 | 0.259 | 0.280 | 1.080 | 0.0538 | D0 |
| 4th example | 0.297 | 0.874 | 0.259 | 0.280 | 1.080 | 0.0534 | D0 |
| 5th example | 0.297 | 0.874 | 0.259 | 0.280 | 1.080 | 0.0534 | D0 |

TABLE 2-continued

| | club mass Mc(kg) | club center of gravity R(m) grip end | primary moment Mc · R (kg · m) | inertial moment I (kg · m^2) about grip end | length of equivalent simple pendulum Lp (m) | inertial moment Ig (kg · m^2) about center of gravity | 14" balance (–) |
|---|---|---|---|---|---|---|---|
| 6th example | 0.296 | 0.876 | 0.259 | 0.280 | 1.081 | 0.0532 | D0 |
| com. example | 0.298 | 0.870 | 0.259 | 0.281 | 1.084 | 0.0554 | D0 |

From the above analysis, it is apparent that to decrease the inertial moment I about the grip and the length of the equivalent simple pendulum, the shaft should be configured so that the linear density of the shaft is generally uniform throughout a certain section of the entire shaft, especially, at the tip side of the shaft.

The portion where the linear density of the shaft is generally uniform must occupy 30% or more of the entire shaft length (analysis examples 1 to 6). Preferably, the portion in which the linear density is generally uniform occupies 30% or more of the entire shaft length between the central portion and the butt (analysis examples 1 to 6). More preferably, the portion in which the linear density is generally uniform occupies the shaft entirely from the middle portion to the butt (analysis examples 1, 2, 5, and 6).

In another example, the portion in which the linear density is generally uniform occupies the shaft excluding a portion corresponding to 30% of the entire shaft length from the tip (analysis examples 5 and 6). It is preferable that the generally uniform portion be generally the entire length of the shaft (analysis example 5).

The shaft is normally manufactured through a sheet winding process. However, when forming a shaft having a linear density distribution in accordance with the present invention, the number of sheets may not be an integer, that is, the entire circumference of the shaft may not be covered at a certain position in the axial direction of the shaft. Thus, the number of superimposed sheets must be locally changed. This may cause the hardness of the shaft to differ between positions in the axial direction. There is a high possibility that this may affect the quality of the shaft. Thus, it is preferred that the shaft be manufactured through a process other than a sheet winging process, that is, through a braiding process, a filament winding process, or a process combining a sheet winding process and a braiding process.

A process combining the sheet winding process and the braiding process will now be discussed.

As apparent from FIGS. 2 and 3, in the portion formed through the sheet winding process, the minimal value in the linear density distribution of the shaft exists in a section extending from about 100 mm to 400 mm, which does not include the reinforced tip. In other words, a characteristic of the linear density distribution is in that the linear density decreases from the tip of the shaft to the position corresponding to the minimal value and increases generally uniformly from the position corresponding to the minimal value to the butt of the shaft. Accordingly, mass does not have to be added at the portion in which the minimal value is located.

Therefore, in the portion formed through a braiding process, the braiding angle of the braiding yarns is maximized and the overlapping of fibers is increased near the position in which the minimal value is located. This increases the thickness of the braid layer. The braiding angle is decreased and the overlapping of fibers is decreased as the grip becomes closer. The rate for decreasing the braiding angle will now be described.

When the taper rate (described later) of the inner diameter of the braid layer is about 0.007 to 0.010 and relatively large, the length of a first portion in the shaft at which the linear density is generally uniform is represented by "x" (mm). In the first portion, the braiding angle is varied in a linear manner relative to the distance from the tip of the shaft. Further, the difference Δθ (°) between the braiding angle of the braiding yarns at the butt side end of the first portion and the braiding angle of the braiding yarns at the tip side end of the first portion is set to be in the range of −0.03x to −0.05x.

If the first portion, in which the linear density is to be generally uniform, has a length of 1000 mm when the above taper rate is applied, based on the calculation of −0.03×1000=−30(°) and −0.05×1000=−50(°), the difference Δθ (°) between the braiding angles should be in the range of −30° to −50°. If the portion in which the linear density is to be generally uniform has a length of 800 mm, based on the same calculation, the difference Δθ between the braiding angles should be in the range of −24° to −40°.

When the taper rate of the braid layer is about 0.004 to 0.006 and relatively small, the length of a portion in the shaft at which the linear density is generally uniform is represented by "x" (mm). In this portion, the braiding angle is varied in a linear manner relative to the distance from the tip of the shaft. Further, the difference Δθ (°) between the braiding angle of the braiding yarns at the butt side end of the portion and the braiding angle of the braiding yarns at the tip side end of the portion is set to be in the range of −0.01x to −0.03x.

If the portion in which the linear density is to be generally uniform has a length of 1000 mm, the difference Δθ between the braiding angles should be in the range of −10° to −30°. If the portion in which the linear density is to be generally uniform has a length of 800 mm, based on the same calculation, the difference Δθ (°) between the braiding angles should be in the range of −8° to −24°.

The taper rate of the inner diameter of the braid layer, which refers to the taper rate δ of the outer diameter of a mandrel (when directly winding the braid layer on the mandrel) before braiding the braid layer or a shaft (when the shaft is arranged on the mandrel), is a value represented by $\delta=(d\mathbf{1}-d\mathbf{2})/\theta$. In the equation, d1 (mm) represents the outer diameter of the mandrel or shaft at a first position along the axis of the shaft, and d2 (mm) represents the outer diameter of the mandrel or shaft at a second position that is closer to the tip of the shaft than the first position. Further, the condition of (d1>d2) is satisfied, and the distance between the first position and the second position is represented by Δ (mm).

A technique was developed to make the linear density generally uniform when combining the sheet winding process and the braiding process.

Figure 4:
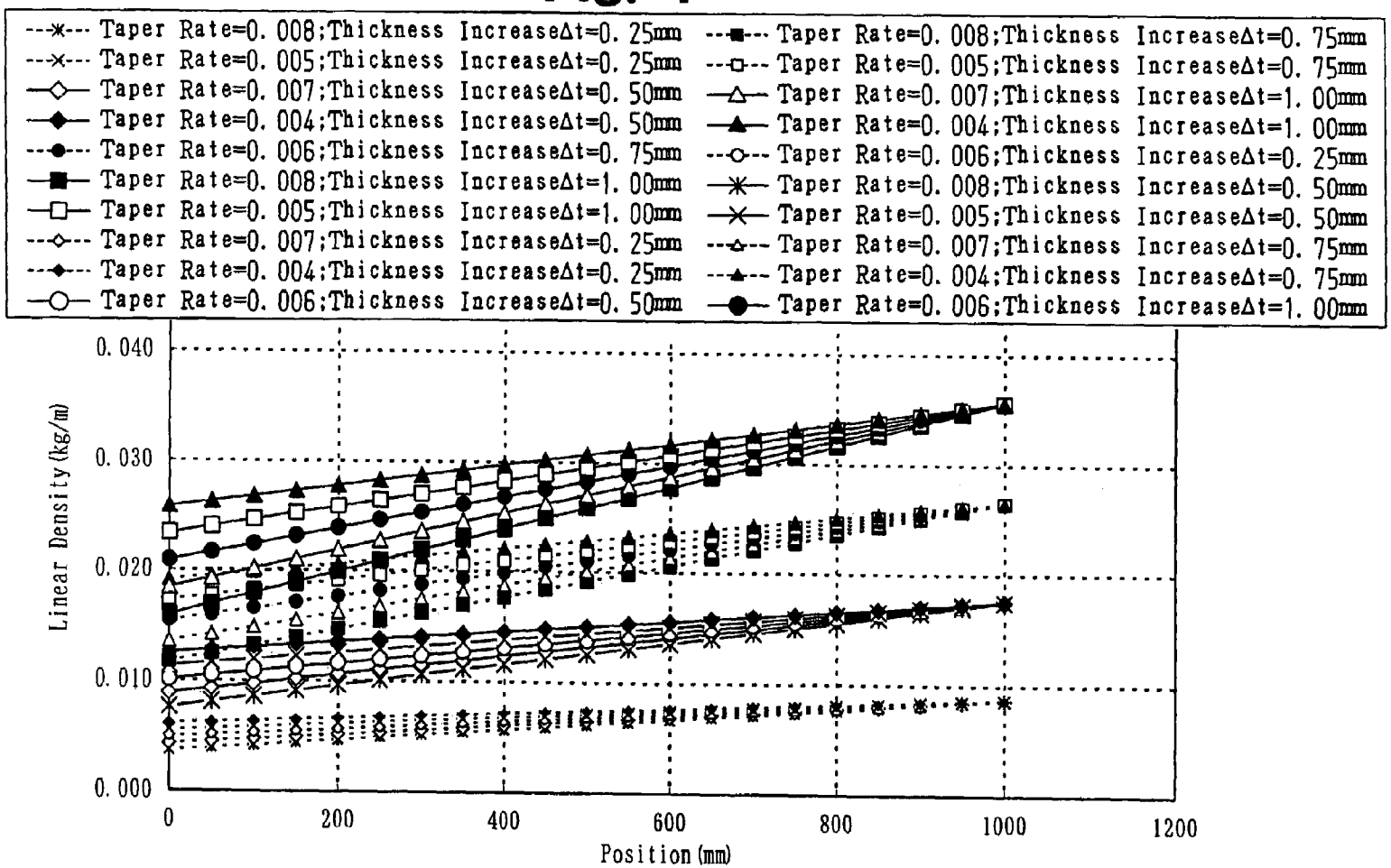
FIG. 4 is a graph showing the linear density distribution of a sheet portion in a shaft of a preferred embodiment according to the present invention.

FIG. 4 shows the linear density distribution in a sheet portion defined between the tip and butt for twenty types of shafts. The outer diameter of the mandrel that was used had a diameter of ϕ14.0 mm at a position (first position) separated 1000 mm from the tip (second position). The outer diameter taper rate of the mandrel (taper rate of the inner diameter of the shaft) was 0.004, 0.005, 0.006, 0.007, or 0.008. The thickness increase θt of the sheet portion in the shaft was 0.25 mm, 0.50 mm, 0.75 mm, or 1.00 mm. It is apparent that the linear density increases uniformly in a generally linear manner from the tip to the butt.

Figure 5:
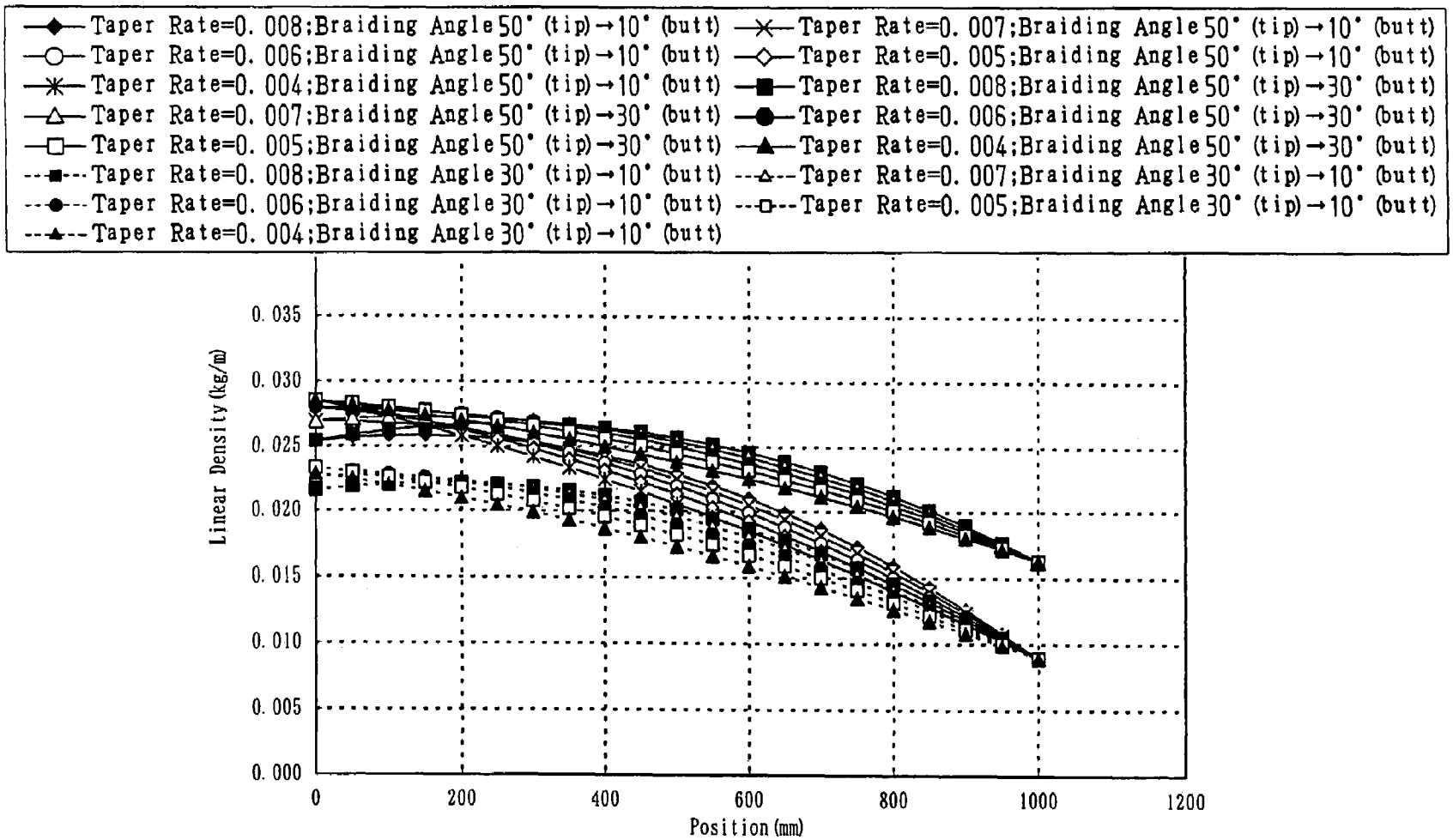
FIG. 5 is a graph showing linear density distribution of a braid layer in the shaft of the preferred embodiment.

FIG. 5 shows the linear density distribution of the braid layer from the tip to the butt in fifteen types of shafts. The mandrel outer diameter and the mandrel outer diameter taper rate (taper rate of the shaft inner diameter) is the same as in the example of FIG. 4.

For the braid layer, a set of eight braiding yarns for the left side and a set of eight braiding yarns totaling to sixteen braiding yarns was used. The braiding yarn is a carbon fiber strand of UT500 (product of Toho Tenax Co., Ltd., yarn filament count is 12000, fiber yield is 1230 g/km, and resin containing rate is about 35%). In a number of examples, the braiding angle between the tip and butt (1000 mm from the tip) of the braiding yarns varied in a linear manner relative to the distance from the tip of the shaft, from 50° to 10°, from 50° to 30°, or from 30° to 10°. In the example in which the braiding angle is varied from 10° at the butt to 50° at the tip, the difference Δθ between the braiding angles of braiding yarns at the butt and the braiding angle of braiding yarns at the tip is calculated as 10°−50°=−40°. In the example in which the angle varies from 30° to 50°, the difference Δθ between the braiding angles is −20°. In the example in which the angle varies from 10° to 30°, the difference Δθ between the braiding angles is −20°. Unlike the shaft of FIG. 4, the linear density decreases from the tip to the butt as the diameter of the mandrel increases.

Figure 6:
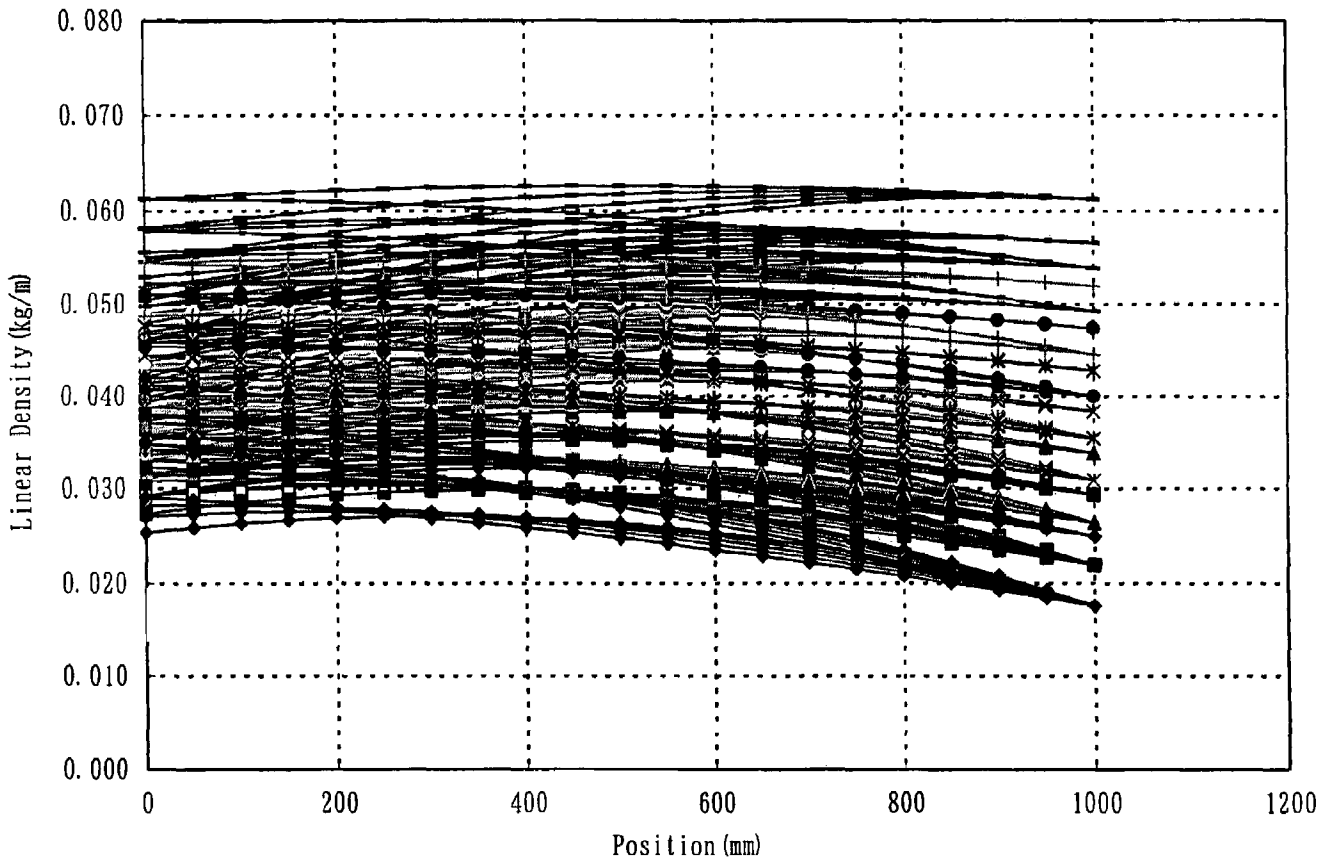
FIG. 6 is a graph showing linear density distribution that combines the linear density distribution of FIG. 4 and the linear density distribution of FIG. 5.

FIG. 6 is the linear density distribution obtained when simply adding the linear density of the sheet portions of FIG. 4 to the linear density of the braid layers of FIG. 5 (diagram showing the linear density distribution when the braiding angle is varied). There are examples in which the linear density locally decreases as the butt becomes closer. However, it is apparent that in most of the examples, the linear density is uniform from the tip to a position located 1000 mm from the tip or in the portion corresponding to 30% or more of the entire shaft length (about 300 mm or greater). In other words, linear density data is approximated by the method of least squares to the linear expression f(x)=ax+b, in which the inclination "a" is as shown below.

$$a \leqq \pm 0.000010[(\mathrm{kg/m})/\mathrm{mm}]$$

The following facts have become apparent from the above.

When the inner diameter taper rate of the braid layer is 0.007 or 0.008 and relatively large or when the thickness increase of the sheet portion is 0.75 or 1.00 mm and relatively large, the linear density is made uniform in the following manner. When the length of the first portion at which the linear density is to be uniform is represented by "x" (mm), the braiding angle relative to the distance from the shaft tip in the first portion is varied in a linear manner. Further, the difference Δθ (°) between the braiding angle of the braiding yarns at the butt side end of the first portion and the braiding angle of the braiding yarns at the tip side end of the first portion is set to be in the range of −0.03x to −0.05x.

When the taper rate of the braid layer is 0.004, 0.005, or 0.006 and relatively small or when the thickness increase of the sheet portion is 0.25 mm or 0.50 mm and relatively small, the linear density is made uniform in the following manner. When the length of the first portion at which the linear density is to be uniform is represented by "x" (mm), the braiding angle relative to the distance from the shaft tip in the first portion is varied in a linear manner. Further, the difference Δθ (°) between the braiding angle of the braiding yarns at the butt side end of the first portion and the braiding angle of the braiding yarns at the tip side end of the first portion is set to be in the range of −0.01x to −0.03x.

A shaft manufactured through the braiding process and a shaft manufactured through a combination of the sheet winding process and the braiding process will now be discussed.

Used mandrel: length 1450 mm, diameter of small-diameter end 4.00 mmϕ, diameter of large-diameter end 13.65 mmϕ (or 14.00 mmϕ)

Used braiding yarn: roping yarn formed from carbon fiber strand impregnated with a one-component modified epoxy resin and selected from below.

(1) UT500-12K (roping yarn product of Nippon Oil Corporation), yarn filament count is 12000, fiber yield is 1230 g/km, and resin containing rate is about 35%, and tensile modulus is 240 GPa.

(2) T700-6K (roping yarn product of Toray Industries, Inc.) yarn filament count is 6000, fiber yield is 615 g/km, resin containing rate is about 35%, and tensile modulus is 240 GPa.

(3) M40J-12K (roping yarn product of Toray Industries, Inc.) yarn filament count is 12000, fiber yield is 692 g/km, resin containing rate is about 35%, and tensile modulus is 400 GPa.

The reinforced fibers of the sheet portion are carbon fibers. Prepeg sheets (resin containing rate Rc is 20 to 30%, and thickness is 0.05 to 0.2 mm) formed by carbon fibers, which are impregnated with epoxy resin in a semi-solidified state and which have a tensile modulus of 240 GPa, 300 GPa, 400GPa, or 460 GPa, are used. To improve the working efficiency, the thickness of a hoop sheet, in which reinforced fibers are wound in the circumferential direction, is about 0.05 to 0.10 mm.

Figure 7:
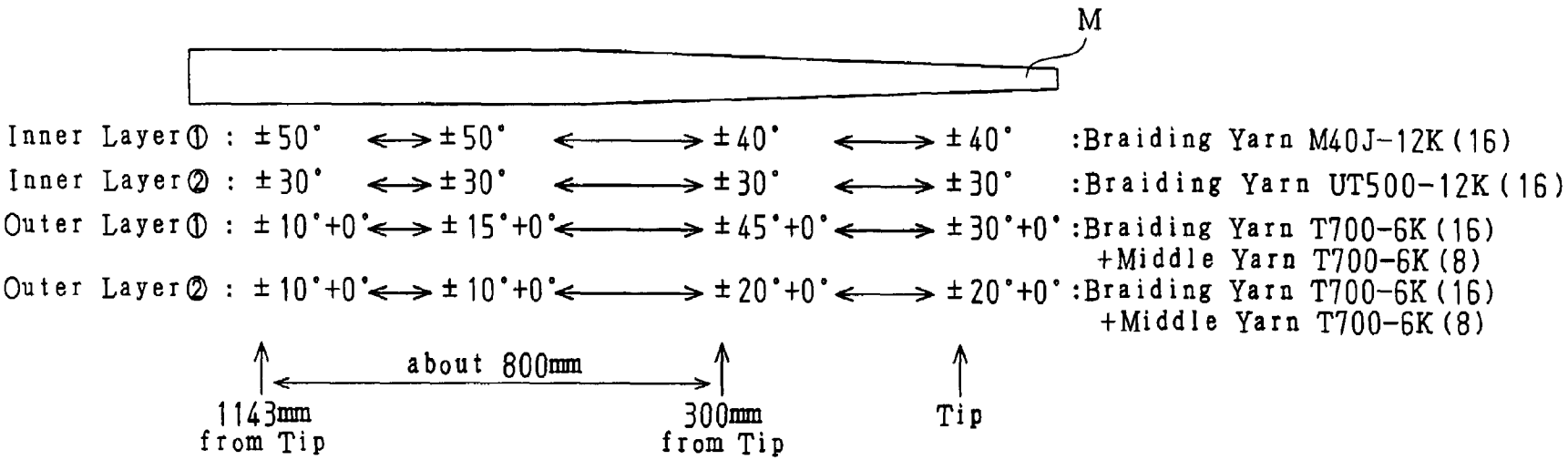
FIG. 7 is a schematic diagram showing a shaft manufactured through the braiding process.

FIG. 7 is a schematic diagram showing an example of a shaft manufactured through the braiding process. FIG. 7 shows a bar-like member M, which is used as a mandrel for manufacturing the shaft. As viewed in the drawing, a small-diameter end portion is defined at the right side of the mandrel (tip side of shaft), and a large-diameter end portion is defined at the left side of the mandrel (butt side of shaft). The shaft of this example is substantially the same as that of the fifth analysis example of the present invention.

The shaft manufactured through the process of FIG. 7 has four braid layers. Among the four braid layers, a first inner layer, which is located near the mandrel M, has eight left braiding yarns (M40J-12K) and eight right braiding yarns (M40J-12K). The left and right braiding yarns are arranged at symmetric orientation angles relative to the axis of the shaft. As shown in FIG. 7, the orientation angle of the braiding yarns varies from the tip to the butt of the shaft along the shaft axis in a range of ±40° to ±50°. A second inner layer is located on the outer side of the first inner layer. The second inner layer has eight left braiding yarns (UT500-12K) and eight right braiding yarns (UT500-12K). The left and right braiding yarns are arranged at symmetric orientation angles relative to the axis of the shaft. The orientation angle of the braiding yarns is ±30° throughout the entire length of the shaft.

A first outer layer is located on the outer side of the second inner layer. The first outer layer has eight left braiding yarns (T700-6K), eight right braiding yarns (T700-6K, and eight middle yarns (T700-6K). The left and right braiding yarns are arranged at symmetric orientation angles relative to the axis of the shaft. The middle yarns are arranged at an orientation angle of ±0° relative to the axis of the shaft. In a second outer layer, the orientation angles of left and right braiding yarns differ from those of the first outer layer. However, the same braiding yarns as the first outer layer are used in the second outer layer.

The orientation angle of the braiding yarns in the first outer layer is ±45° relative to the shaft axis at a position located 300 mm from the tip and ±10° relative to the shaft axis at the butt portion, which is located 1143 mm from the tip. Further, the braiding angle difference Δθ is −35° for a section of about 800 mm.

The orientation angle of the braiding yarns in the second outer layer is ±20° relative to the shaft axis at a position located 300 mm from the tip and ±10° relative to the shaft axis at the butt portion, which is located 1143 mm from the tip. Further, the braiding angle difference Δθ is −10° for a section of about 800 mm.

By grinding the outermost layer, the shaft, which has the desired linear density, is easily finished.

Figure 8:
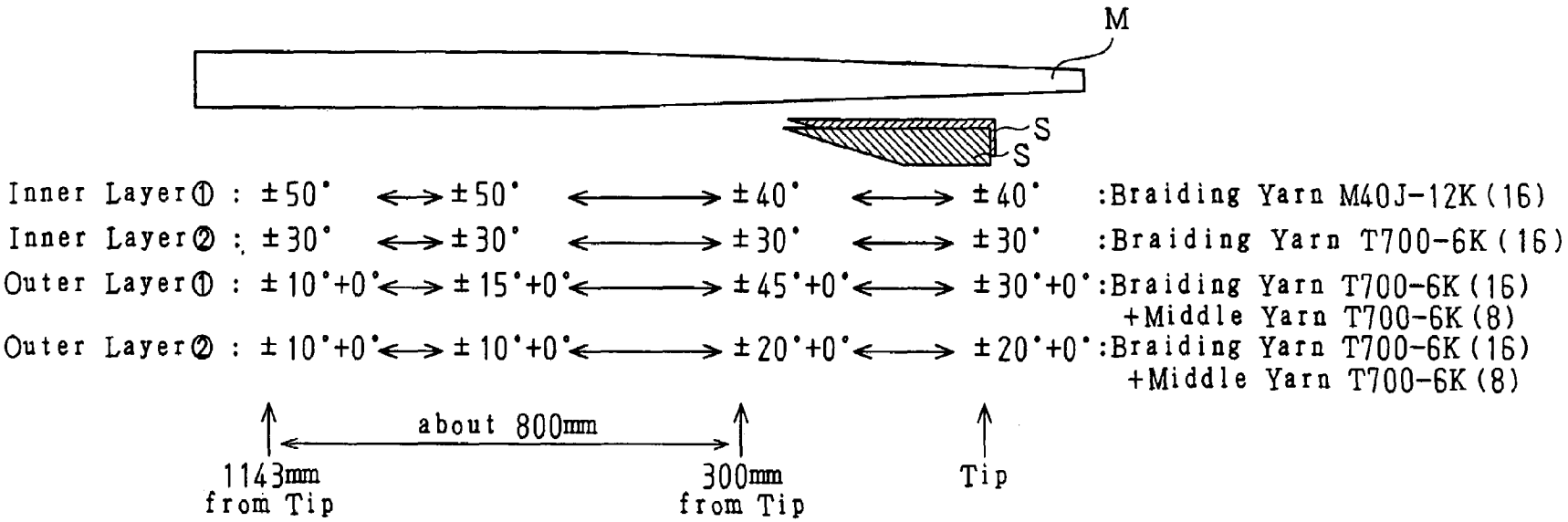
FIG. 8 is a schematic diagram showing a process for manufacturing the shaft formed through the braiding process after winding a prepreg sheet reinforcement piece to a portion corresponding to a tip portion of the shaft of a mandrel.

FIG. 8 is a schematic diagram showing an example of a shaft (shaft of the third example of the present invention) finished through the braiding process after winding reinforcing pieces S of prepreg sheets to the portion about portions of the mandrel M that correspond to the tip portion of the shaft. The shaft manufactured through the process of FIG. 8 includes two prepreg sheets and four braid layers. Two bias sheets in which carbon fibers are wound in inclination relative to the shaft axis are used as the prepreg sheets. The inclination angle of the fibers in one of the sheets S is in symmetric relation with the inclination angle of the fibers in the other one of the sheets. The structures of the braid layers arranged on the prepreg sheets are as shown in FIG. 8. Although the sheets S of FIG. 8 are bias sheets, the sheets may be straight sheets in which the braiding yarns are arranged at an angle of 0° relative to the shaft axis.

The shaft of FIG. 8 has four braid layers. Among the four braid layers, a first inner layer, which is located near the mandrel M, has eight left braiding yarns (M40J-12) and eight right braiding yarns (M40J-12). The left and right braiding yarns are arranged at symmetric orientation angles relative to the axis of the shaft. As shown in FIG. 8, the orientation angle of the braiding yarns varies from the tip to the butt of the shaft along the shaft axis in a range of ±40° to ±50°.

A second inner layer is located on the outer side of the first inner layer. The second inner layer has eight left braiding yarns (T700-6K) and eight right braiding yarns (T700-6K). The left and right braiding yarns are arranged at symmetric orientation angles relative to the axis of the shaft. The orientation angle of the braiding yarns is ±30° throughout the entire length of the shaft.

A first outer layer is located on the outer side of the second inner layer. The first outer layer has eight left braiding yarns (T700-6K), eight right braiding yarns (T700-6K), and eight middle yarns (T700-6K). The left and right braiding yarns are arranged at symmetric orientation angles relative to the axis of the shaft. The middle yarns are arranged at an orientation angle of ±0° relative to the axis of the shaft. In a second outer layer, the orientation angles of left and right braiding yarns differ from those of the first outer layer. However, the same braiding yarns as the first outer layer are used in the second outer layer.

The orientation angle of the braiding yarns in the first outer layer is ±45° relative to the shaft axis at a position located 300 mm from the tip and ±10° relative to the shaft axis at the butt portion, which is located 1143 mm from the tip. Further, the braiding angle difference Δθ is ±35° for a section of about 800 mm. The orientation angle of the braiding yarns in the second outer layer is ±20° relative to the shaft axis at a position located 300 mm from the tip and ±10° relative to the shaft axis at the butt portion, which is located 1143 mm from the tip. Further, the braiding angle difference Δθ is −10° for a section of about 800 mm.

Figure 9:
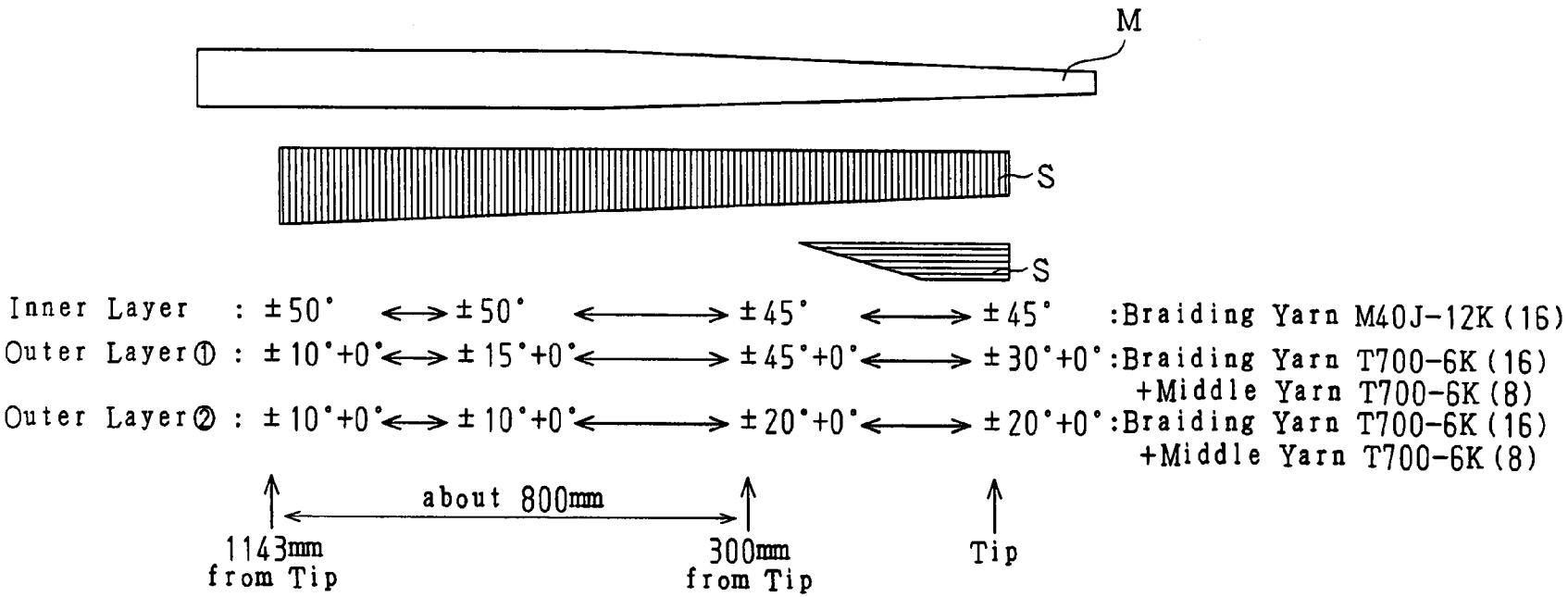
FIG. 9 is a schematic diagram showing a process for manufacturing the shaft formed through the braiding process after winding a prepreg sheet to a portion corresponding to 20 to 50% of the entire mass of the shaft.
Figure 10:
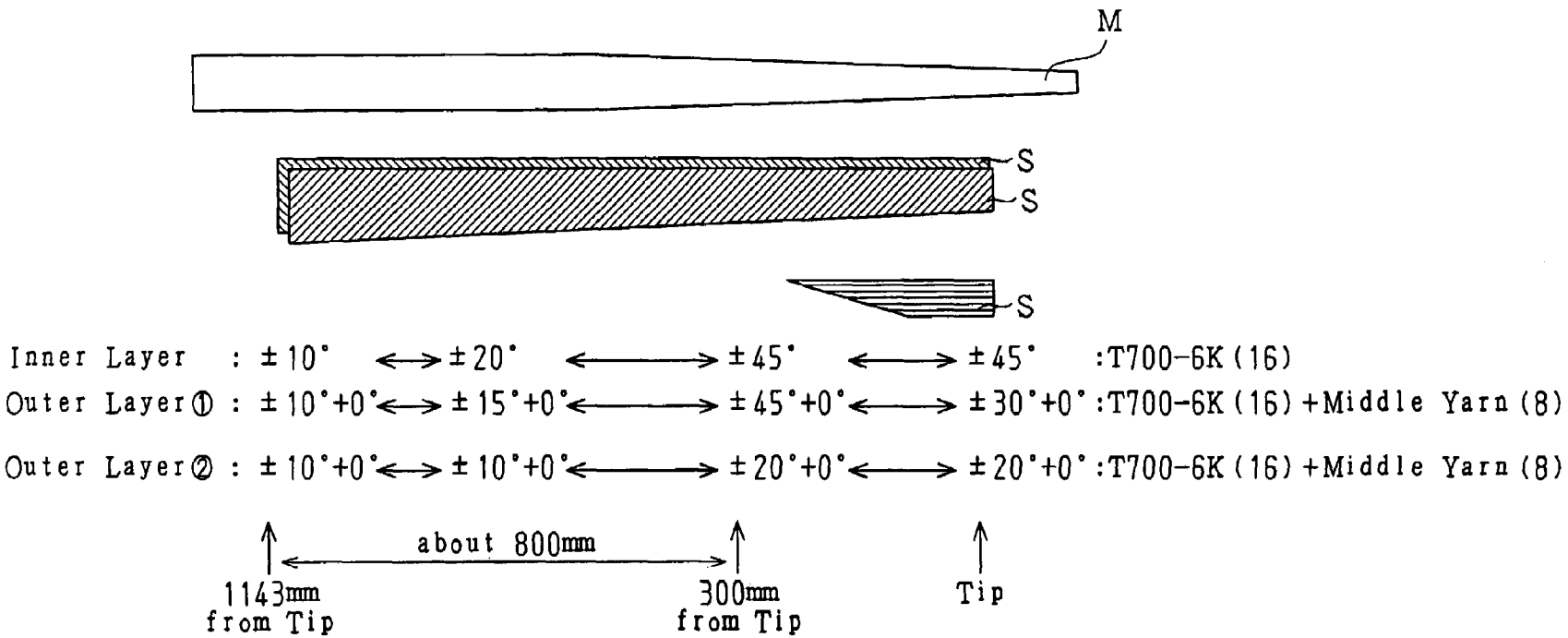
FIG. 10 is a schematic diagram showing a process for manufacturing a shaft differing from that of FIG. 6 formed through the braiding process after winding a prepreg sheet to a portion corresponding to 20 to 50% of the entire mass of the shaft.

FIGS. 9 and 10 are schematic diagram showing examples of shafts (shafts of the first and second examples of the present invention) finished through the braiding process after winding prepreg sheets corresponding to 20 to 50% of the entire shaft mass.

The shaft manufactured through the process of FIG. 9 includes two prepreg sheets S and three braid layers. An inner prepreg sheet is a hoop sheet in which the reinforced fibers are wound in the circumferential direction. An outer sheet is wound about the mandrel M at the tip portion of the shaft. The outer sheet is a straight sheet in which reinforced fibers are arranged parallel to the shaft axis. The structures of the braid layers arranged on the prepreg sheets are as shown in FIG. 9.

The shaft of FIG. 9 has three braid layers. Among the three braid layers, an inner layer, which is located near the inner prepreg sheet, has eight left braiding yarns (M40J-12K) and eight right braiding yarns (M40J-12K). The left and right braiding yarns are arranged at symmetric orientation angles relative to the axis of the shaft. As shown in FIG. 9, the orientation angle of the braiding yarns varies from the tip to the butt of the shaft along the shaft axis in a range of ±45° to ±50°.

A first outer layer is located on the outer side of the inner layer. The first outer layer has eight left braiding yarns (T700-6K), eight right braiding yarns (T700-6K), and eight middle yarns (T700-6K). The left and right braiding yarns are arranged at symmetric orientation angles relative to the axis of the shaft. The middle yarns are arranged at an orientation angle of ±0° relative to the axis of the shaft. In a second outer layer, the orientation angles of left and right braiding yarns differ from those of the first outer layer. However, the same type and quantity of braiding yarns as the first outer layer are used in the second outer layer.

The orientation angle of the braiding yarns in the first outer layer is ±45° relative to the shaft axis at a position located 300 mm from the tip and ±10° relative to the shaft axis at the butt portion, which is located 1143 mm from the tip. Further, the braiding angle difference Δθ is −35° for a section of about 800 mm. The orientation angle of the braiding yarns in the second outer layer is ±20° relative to the shaft axis at a position located 300 mm from the tip and ±10° relative to the shaft axis at the butt portion, which is located 1143 mm from the tip. Further, the braiding angle difference Δθ is −10° for a section of about 800 mm.

The shaft manufactured through the process of FIG. 10 includes three prepreg sheets S and three braid layers. Two inner prepreg sheets are bias sheets in which the inclination angle of the fibers in one of the sheets is in symmetric relation with the inclination angle of the fibers in the other one of the sheets. An outer sheet is wound about the mandrel M at the tip portion of the shaft. The outer sheet is a straight sheet in which reinforced fibers are arranged parallel to the shaft axis. The structures of the braid layers arranged on the prepreg sheets are as shown in FIG. 10.

The shaft of FIG. 10 has three braid layers. Among the three braid layers, an inner layer, which is located near the inner prepreg sheet, has eight left braiding yarns (M40J-12K) and eight right braiding yarns (M40J-12K). The left and right braiding yarns are arranged at symmetric orientation angles relative to the axis of the shaft. As shown in FIG. 10, the orientation angle of the braiding yarns from the tip of the shaft to a position located 300 mm from the tip along the shaft axis is ±45°. The orientation angle of the braiding yarns is ±10° relative to the shaft axis at the butt portion. Further, the braiding angle difference Δθ is −35° for a section of about 800 mm between 300 mm and 1143 mm from the tip.

A first outer layer is located on the outer side of the inner layer. The first outer layer has eight left braiding yarns (T700-6K), eight right braiding yarns (T700-6K), and eight middle yarns (T700-6K). The left and right braiding yarns are arranged at symmetric orientation angles relative to the axis of the shaft. The middle yarns are arranged at an orientation angle of +0° relative to the axis of the shaft. In a second outer layer, the orientation angles of left and right braiding yarns differ from those of the first outer layer. However, the same type and quantity of braiding yarns as the first outer layer are used in the second outer layer.

The orientation angle of the braiding yarns in the first outer layer is ±45° relative to the shaft axis at a position located 300 mm from the tip and ±10° relative to the shaft axis at the butt portion, which is located 1143 mm from the tip. Further, the braiding angle difference Δθ is −35° for a section of about 800 mm. The orientation angle of the braiding yarns in the second outer layer is ±20° relative to the shaft axis at a position located 300 mm from the tip and ±10° relative to the shaft axis at the butt portion, which is located 1143 mm from the tip. Further, the braiding angle difference Δθ is −10° for a section of about 800 mm.

Figure 11:
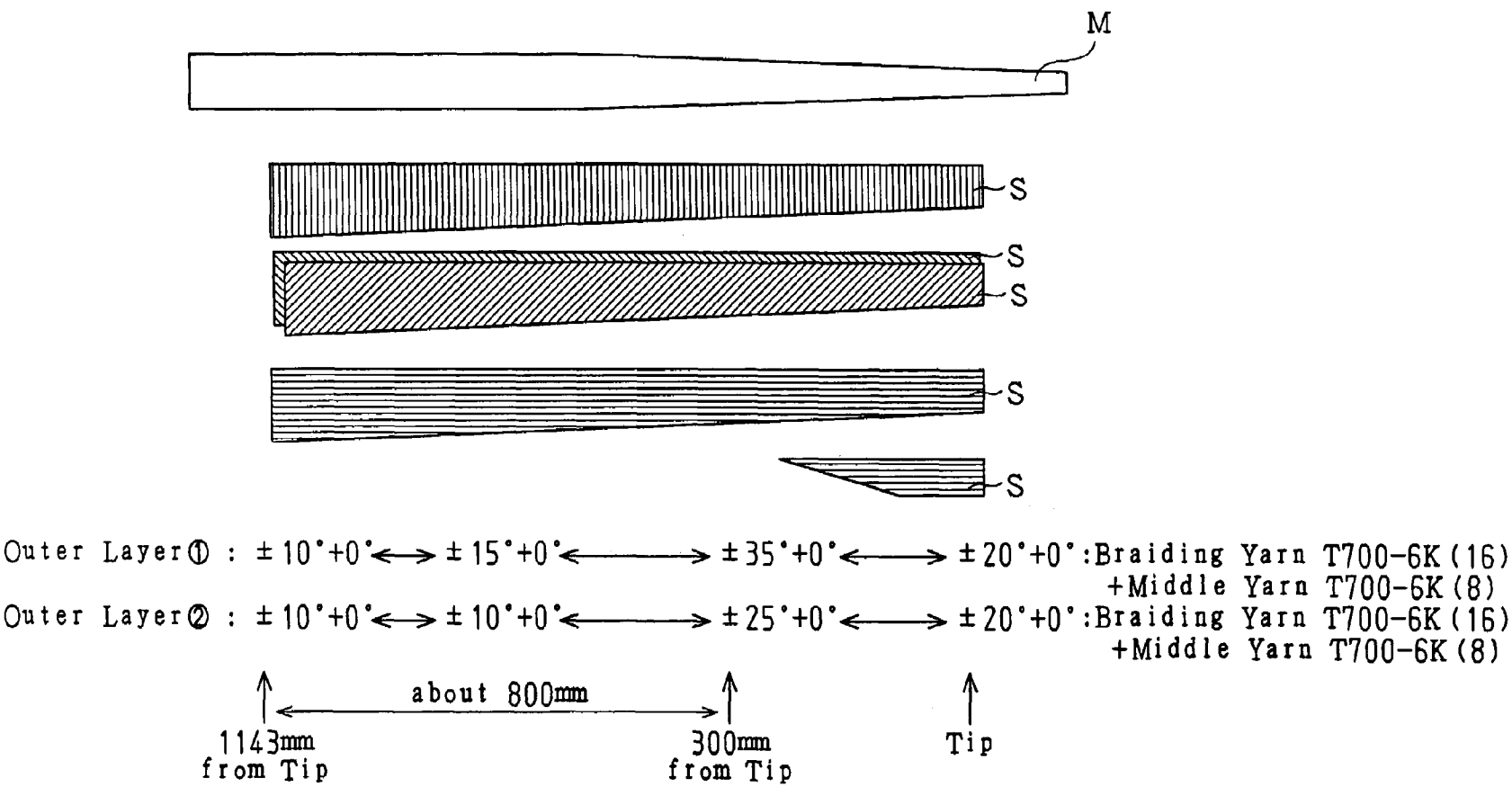
FIG. 11 is a schematic diagram showing a process for manufacturing the shaft formed through the braiding process after winding a prepreg sheet to a portion corresponding to 50 to 70% of the entire mass of the shaft.

FIG. 11 is a schematic diagram showing an example of a shaft (shaft of the fourth example of the present invention) finished through the braiding process after winding prepreg sheets corresponding to 20 to 50% of the entire shaft mass. The shaft manufactured through the process of FIG. 11 includes five prepreg sheets S and two braid layers. From the inner side to the outer side, the five prepreg sheets are a hoop layer, two bias sheets, a straight layer, and a straight layer for the tip portion. The inclination angle of the fibers in one of the bias sheets is in symmetric relation with the inclination angle of the fibers in the other one of the bias sheets. The structures of the braid layers arranged on the prepreg sheets are as shown in FIG. 11.

The shaft of FIG. 11 has two braid layers. A first outer layer is located on the outer side of the prepreg sheets. The first outer layer has eight left braiding yarns (T700-6K), eight right braiding yarns (T700-6K), and eight middle yarns (T700-6K). The left and right braiding yarns are arranged at symmetric orientation angles relative to the axis of the shaft. The middle yarns are arranged at an orientation angle of +0° relative to the axis of the shaft. In a second outer layer, the orientation angles of left and right braiding yarns differ from those of the first outer layer. However, the same type and quantity of braiding yarns as the first outer layer are used in the second outer layer.

The orientation angle of the braiding yarns in the first outer layer is ±35° relative to the shaft axis at a position located 300 mm from the tip and ±10° relative to the shaft axis at the butt portion, which is located 1143 mm from the tip. Further, the braiding angle difference Δθ is −25° for a section of about 800 mm. The orientation angle of the braiding yarns in the second outer layer is ±25° relative to the shaft axis at a position located 300 mm from the tip and ±10° relative to the shaft axis at the butt portion, which is located 1143 mm from the tip. Further, the braiding angle difference Δθ is −15° for a section of about 800 mm.

Figure 12:
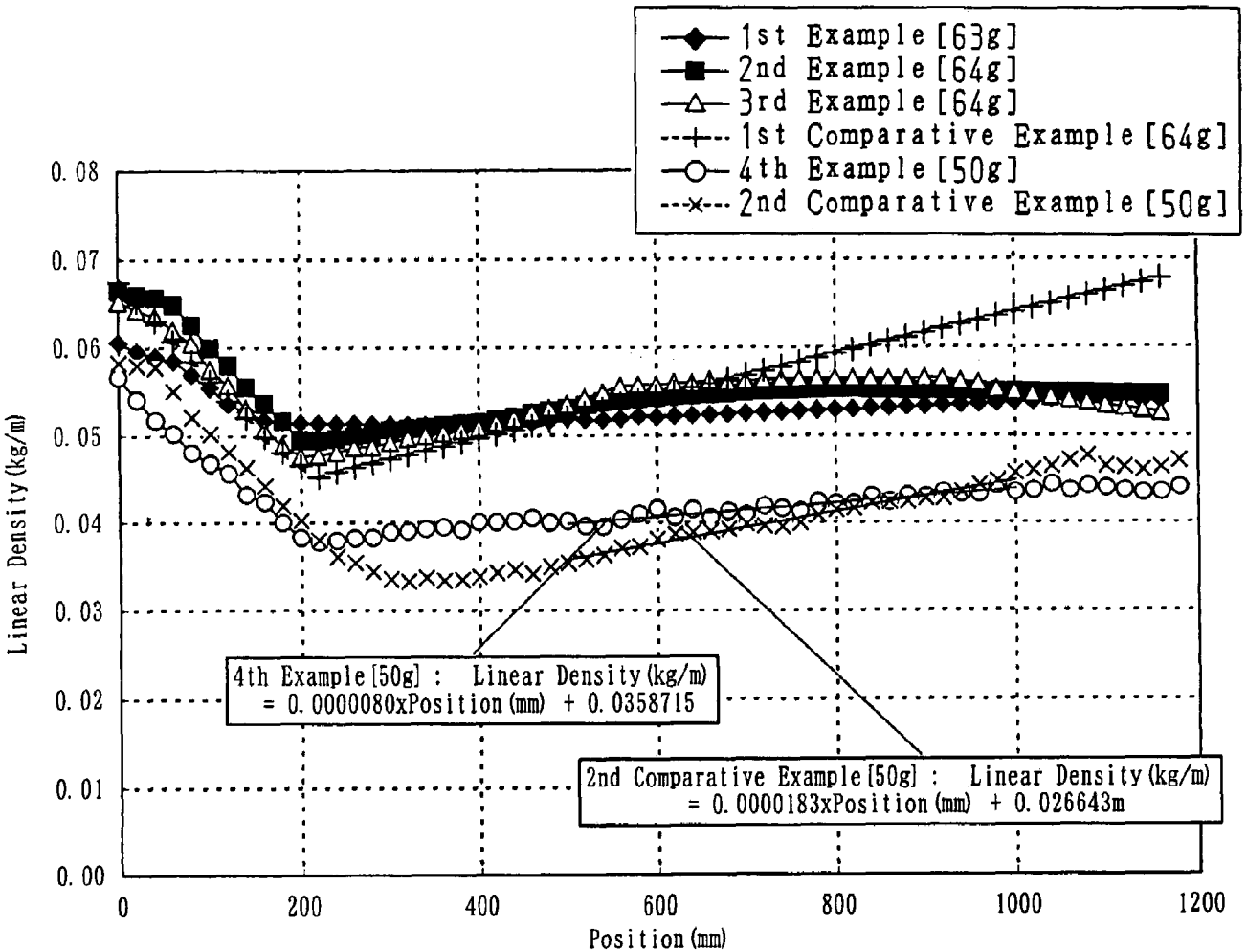
FIG. 12 is a graph illustrating linear density distribution in first to fourth examples of shafts according to the present invention and first and second comparative examples.

FIG. 12 shows the linear density distribution for the shafts of the first to fourth examples of the present invention and the shafts of the first and second comparative examples. The vertical axis represents the linear density (kg/m), and the horizontal axis represents the distance (mm) from the tip of the shaft. The linear density in the shafts of the first to fourth examples varies continuously and smoothly along the axis of the shaft. The shaft mass Ms is 0.065 kg in the shafts of the first to third examples and the first comparative example. The shaft mass Ms is 0.050 kg in the shafts of the fourth example and the second comparative example. The shafts of the first and second comparative examples are manufactured through the sheet winding process.

The first portion in which the linear density is generally uniform refers to a portion in which linear density data is approximated by the method of least squares to the linear expression f(x)=ax+b. The inclination "a" is as shown below.

$$a \leqq \pm 0.000010 [(\mathrm{kg/m})/\mathrm{mm}]$$

It is preferred that the deviation of the linear density data relative to the approximated linear data be in the range of ±0.002 (kg/m).

When the inclination "a" is not included in the above range, the inertial moment I and the length of equivalent simple pendulum Lp may increase. Further, a combination of a head, shaft, and grip with the desired primary moment Mc·R that satisfies equation (1), which is described above, may not be obtained.

Table 3 shows the properties of the shafts of the first to fourth examples of the present invention and the shafts of the first and second comparative examples. It is apparent that the inertial moment Ig about the center of gravity of the shaft is greatest in the first comparative example.

TABLE 3

| | length (mm) | mass Ms(g) | center of gravity (mm) baseline grip | center of gravity rate (%) baseline grip | inertial moment Ig (kg · m^2) about center of gravity of shaft |
|---|---|---|---|---|---|
| Example 1 | 1143 | 63 | 567 | 49.6 | 0.00704 |
| Example 2 | 1143 | 64 | 579 | 50.7 | 0.00750 |
| Example 3 | 1143 | 64 | 571 | 49.9 | 0.00724 |
| Com. Example 1 | 1143 | 64 | 547 | 47.8 | 0.00775 |

| | length (mm) | mass Ms(g) | center of gravity (mm) baseline grip | center of gravity rate (%) baseline grip | inertial moment Igs (kg · m^2) about center of gravity of shaft |
|---|---|---|---|---|---|
| Example 4 | 1143 | 50 | 568 | 49.7 | 0.00595 |
| Com. Example 2 | 1143 | 50 | 570 | 49.9 | 0.00630 |

Table 4 shows the inertial moment I about the grip end and the length of equivalent simple pendulum Lp of the shafts of the first to fourth examples of the present invention and the shafts of the first and second comparative examples. In the first to third examples and the first comparative example, the head mass Mh is 0.195±0.001 (kg), the grip mass Mg is 0.050 kg, the club length Lc is 45 inches (1143 mm), and the primary moment is Mc·R is 0.266 kgm. In the fourth example and the second comparative example, the head mass Mh is 0.192 (kg), the grip mass Mg is 0.042 kg, the club length Lc is 45 inches (1143 mm), and the primary moment is Mc·R is 0.255 kgm.

In each of the first to fourth examples of the present invention, the values of the inertial moment I and the length of equivalent simple pendulum Lp are greater than those of the comparative examples.

TABLE 4

| | club mass Mc(kg) | center of gravity of club R(m) grip end | primary moment Mc · R (kg · m) | inertial moment I (kg · m^2) about grip end | length of equivalent simple pendulum Lp (m) | inertial moment Ig (kg · m^2) about center of gravity | 14" balance (–) |
|---|---|---|---|---|---|---|---|
| Example 1 | 0.311 | 0.857 | 0.266 | 0.286 | 1.075 | 0.0582 | D1 |
| Example 2 | 0.311 | 0.855 | 0.266 | 0.286 | 1.074 | 0.0583 | D1 |
| Example 3 | 0.311 | 0.855 | 0.266 | 0.286 | 1.074 | 0.0583 | D1 |
| Com. Example 1 | 0.312 | 0.848 | 0.266 | 0.287 | 1.079 | 0.0615 | D1 |
| Example 4 | 0.287 | 0.888 | 0.255 | 0.276 | 1.083 | 0.0497 | C9 |
| Com. Example 2 | 0.287 | 0.888 | 0.255 | 0.277 | 1.088 | 0.0509 | C9 |

Two professional golf players and five amateur golf players, whose playing skills are between the range of high and intermediate, conducted a driving evaluation test on four clubs employing the shafts of the first, second, and third examples and the first comparative example (table 5, test B) and two clubs employing the shafts of the fourth example and the second comparative example (table 5, test B). The clubs were evaluated using a five point scoring system in which the scores of the first and second comparative examples were given three points. The average score of the seven players was used as the score of each club.

The results are shown in table 5. From the table, it is apparent that most of the players perceived swinging ease and simple timing control with the-clubs employing the shafts of the first to fourth examples.

TABLE 5

| | Test A | | | | Test B | |
|---|---|---|---|---|---|---|
| | Ex. 1 | Ex. 2 | Ex. 3 | Com. Ex. 1 | Ex. 4 | Com. Ex. 2 |
| Driving Distance | 3 | 4 | 4 | 3 | 4 | 3 |
| Driving Direction | 4 | 3 | 4 | 3 | 3 | 3 |
| Impact Feel | 4 | 3 | 3 | 3 | 4 | 3 |
| Swinging Ease | 4 | 4 | 5 | 3 | 5 | 3 |
| Simple Timing Control | 4 | 4 | 5 | 3 | 4 | 3 |
| Evaluation | 4 | 4 | 4 | 3 | 4 | 3 |

The golf shaft according to the present invention has the advantages described below.

The orientation angle of the braiding yarns in the braid layer of the shaft varies to satisfy the desired linear density. This obtains the optimal inertial moment I about the grip end and the optimal length of an equivalent simple pendulum Lp. Accordingly, discomfort caused by the impact feel and the vibrations conveyed to the player's hands is reduced without affecting the outer appearance of the golf shaft, the flexure feel of the golf shaft during swinging, and the durability of the golf shaft while maintaining swinging ease.

The shaft is tapered so that the outer diameter generally increases gradually from the tip to the butt of the shaft. Thus, the outer appearance of the shaft, the flexing of the shaft, and the strength of the shaft are satisfactory.

It should be apparent to those skilled in the art that the present invention may be embodied in many other specific forms without departing from the spirit or scope of the invention. Particularly, it should be understood that the present invention may be embodied in the following forms.

Fibers other than carbon fibers may be used as the reinforced fibers used in the prepreg sheets or the braid layers.

As long as the portion in which the linear density is uniform occupies 30% or more of the entire shaft length, there may be locations where the linear density does not vary continuously.

The butt portion of the shaft to which the grip is attached may have a constant diameter.

In addition to the combination of the sheet winding process and the braiding process, the shaft may be formed through any one of the sheet winding process, the filament winding process, and the braiding process.

The present examples and embodiments are to be considered as illustrative and not restrictive, and the invention is not to be limited to the details given herein, but may be modified within the scope and equivalence of the appended claims.

What is claimed is:

1. A golf shaft comprising:

a rip portion, a butt portion, and a middle portion located between the tip portion and the butt portion, the golf shaft being made of fiber reinforced plastic and including a tapered shape having an outer diameter that generally increases gradually from the tip portion to the butt portion, the golf shaft further including:

a first portion in which linear density is generally uniform;

a second portion defined by the part of the shaft excluding the first portion, the first portion occupying 30% or more of the entire shaft length, and the linear density of the first portion being greater that that of the second portion;

a prepreg sheet; and a braid layer having a braiding yarn arranged on the prepreg sheet, wherein an orientation angle of a braiding yarn in the braid layer is increased at a position in where a minimal value of a linear density distribution of the prepreg sheet is located.

2. The golf shaft according to claim 1, wherein the first portion is located between the middle portion and the butt portion.

3. The golf shaft according to claim 1, wherein the first portion extends entirely from the middle portion to the butt portion.

4. The golf shaft according to claim 1, wherein when linear density data for the first portion is approximated by the method of least squares to the linear expression $f(x)=ax+b$, an inclination "a" of the first portion is expressed by $a \leqq 0.000010$, and deviation of the linear density data relative to the approximated linear data is ±0.002, wherein the unit for the variable "x" is millimeter and the unit for the function f(x) is kg/m.

5. A golf shaft comprising:

a tip portion, a butt portion, and a middle portion located between the tip portion and the butt portion, the golf shaft being made of fiber reinforced plastic and including a tapered shape having an outer diameter that generally increases gradually from the up portion to the butt portion, the golf shaft further including:

a first portion in which linear density is generally uniform;

a second portion defined by the part of the shaft excluding the firs; portion, the first portion occupying 30% or more of the entire shaft length, and the linear density of the first portion being greater that that of the second portion; and braiding yarns forming a braid layer having an inner diameter that includes a taper rare, wherein when the taper raze of the inner diameter of the braid layer is 0.007 to 0.010 and the length of the first portion in which the linear density if generally uniform is represented by "x", wherein the unit for the variable "x" is millimeter, a braiding angle relative to the distance from the shaft tip in the first portion is varied in a linear manner, and a difference $\Delta\theta$ (degrees) between the braiding angle of the braiding yarns at the butt side end of the first portion and the braiding angle of the braiding yarns at the tip side end of the first portion in a range of $-0.03x$ to $-0.05x$.

6. A golf club comprising:

a golf shaft made of fiber reinforced plastic and having a zip portion including a rip, a butt portion including a butt, and a middle portion located between the tip portion and the butt portion;

a head attached to the rip portion of the shaft; and a grip attached to the butt portion of the shaft, the shaft including;

a tapered shape having a an outer diameter that increases gradually from the rip to the butt;

first portion in which linear density is generally uniform;

a second portion defined by the part of the shaft excluding the first portion, the first portion occupying 30% or more of the entire shaft length, and the linear density of the first portion being greater than that of the second portion;

a prepreg sheet; and a braid layer having a braiding yarn arranged on the prepreg sheet, wherein an orientation angle of a braiding yarn in the braid layer is increased at a position in where a minimal value of a linear density distribution of the prepreg sheet is located.

7. The golf club according to claim 6, wherein the first portion is located between the middle portion and the butt.

8. The golf club according to claim 6, wherein the first portion extends entirely from the middle portion to the butt.

* * * * *